US006799390B2

(12) United States Patent
Bradley

(10) Patent No.: US 6,799,390 B2
(45) Date of Patent: Oct. 5, 2004

(54) GREETINGS DEVICE HAVING LOOP FOR SECUREMENT TO A BOTTLE

(76) Inventor: Linda Bradley, RR 1, Bognor, Ontario, N0H 1E0 (CA)

( * ) Notice: Subject to any disclaimer, the term of this patent is extended or adjusted under 35 U.S.C. 154(b) by 134 days.

(21) Appl. No.: 09/792,341

(22) Filed: Feb. 26, 2001

(65) Prior Publication Data

US 2001/0016995 A1 Aug. 30, 2001

(30) Foreign Application Priority Data

Feb. 24, 2000 (GB) ..... 0004332

(51) Int. Cl.[7] ..... G09F 3/00

(52) U.S. Cl. ..... 40/310; 40/124.01; 40/124.06; 40/673; 229/74

(58) Field of Search ..... 40/310, 124.01, 40/124.06, 124.11, 673, 331; 229/68.2, 74

(56) References Cited

U.S. PATENT DOCUMENTS

| | | | | | |
|---|---|---|---|---|---|
| 1,477,123 | A | * | 12/1923 | Hopkins | 40/310 |
| 1,536,445 | A | | 5/1925 | Maupai | |
| 1,699,915 | A | | 1/1929 | Peterson | |
| 1,850,369 | A | | 3/1932 | Andrews | |
| 1,853,622 | A | | 4/1932 | Kennedy | |
| 1,871,598 | A | | 8/1932 | Everson | |
| 1,969,428 | A | | 8/1934 | Schwartz | |
| 1,984,559 | A | | 12/1934 | Wilcox | |
| 2,305,227 | A | * | 12/1942 | Steinhilber | 40/310 |
| 3,149,431 | A | | 9/1964 | Blish | |
| 3,423,861 | A | * | 1/1969 | Forsyth | 40/662 |
| 3,797,658 | A | | 3/1974 | Peacock | |
| 3,831,300 | A | | 8/1974 | Berkhouse | |
| 4,197,984 | A | * | 4/1980 | Hartman et al. | 206/806 |
| 4,208,819 | A | | 6/1980 | Jones et al. | |
| 4,309,835 | A | | 1/1982 | Naeve | |
| 4,378,831 | A | * | 4/1983 | Koltz | 150/147 |
| 4,460,119 | A | * | 7/1984 | Goodfellow et al. | 206/806 |
| 4,462,538 | A | * | 7/1984 | Gendron | 206/806 |
| 4,545,521 | A | * | 10/1985 | Hiersteiner | 229/68.1 |
| D306,614 | S | | 3/1990 | Kodner et al. | |
| 5,289,650 | A | | 3/1994 | Follett et al. | |
| 5,390,435 | A | | 2/1995 | Grody | |
| 5,782,357 | A | | 7/1998 | Johnson | |
| 5,826,356 | A | | 10/1998 | Lapp | |
| 5,960,973 | A | | 10/1999 | Markson | |
| 6,070,719 | A | | 6/2000 | Pollock | |
| 6,385,874 | B1 | * | 5/2002 | Tsonas | 40/124.09 |

* cited by examiner

*Primary Examiner*—William L. Miller
(74) *Attorney, Agent, or Firm*—Anthony Asquith & Co.

(57) ABSTRACT

The device comprises a sheet of paper or card, having a slit formed therein. The slit makes an inverted U-shape, having left and right leg portions, and a cross-bar. The slit divides the sheet into a front panel, on which a greetings message can be written or printed, and a fixing-loop, which slips over the neck of the bottle. The vertical length of the legs of the slit is shorter than the width between the legs, whereby the device comes to rest on the bottle, with the neck of the bottle touching the inside of the front panel and the back of the fixing-loop. The bottle does not touch the legs of the slit. An envelope for the device is also disclosed.

14 Claims, 5 Drawing Sheets

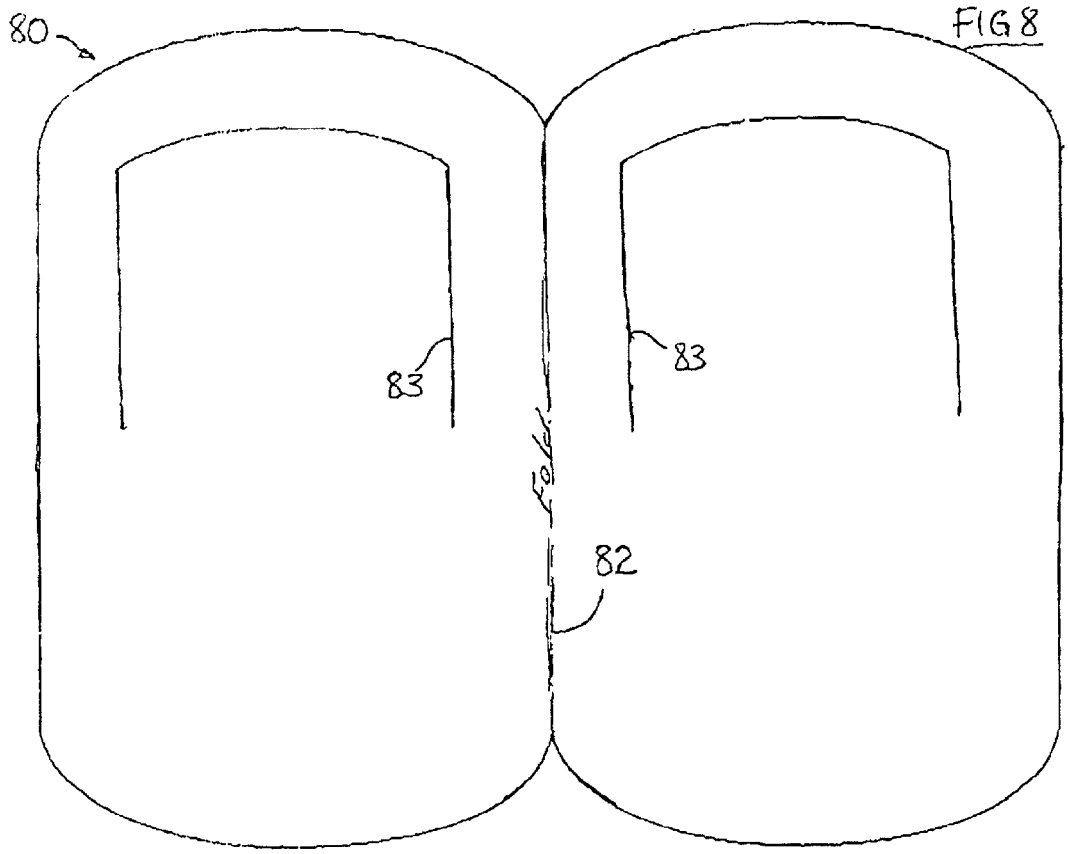
Two Side Tag
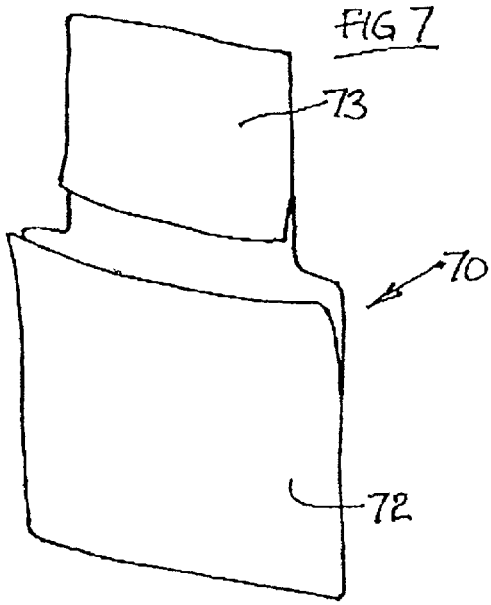

GREETINGS DEVICE HAVING LOOP FOR SECUREMENT TO A BOTTLE

This invention relates to a greetings-device, which is so configured as to be suitable to be slipped over the neck of a wine-bottle.

Traditionally, it has been difficult to attach a greetings message or announcement to a bottle, and people have resorted to the use of sticky tape, etc, which is inconvenient. Or, devices for carrying messages on bottles have been of complex structure, and have been expensive, or fragile, or both.

It is an aim of the invention to provide a greetings-device which is so configured as to be highly suitable for attachment to a bottle. When a person purchases a bottle of wine, champagne, etc, as a gift, the person also adds the greetings-device, which carries an appropriate message in a well-presented manner, such as will supplement and enhance the gift.

Although the device is intended particularly for use with bottles, and is intended to be made available for sale in wine shops and the like, rather than in greetings-card shops, the device may be used for other articles of appropriate shape.

DETAILED DESCRIPTION OF PREFERRED EMBODIMENTS

By way of further explanation of the invention, exemplary embodiments of the invention will now be described with reference to the accompanying drawings, in which:

FIG. 7 is a pictorial view of an envelope for the device.

FIG. 8 is a plan view of a sheet for another version of the device, prior to doubling over.

The apparatuses shown in the accompanying drawings and described below are examples which embody the invention, it should be noted that the scope of the invention is defined by the accompanying claims, and not necessarily by specific features of exemplary embodiments.

Figure 1:
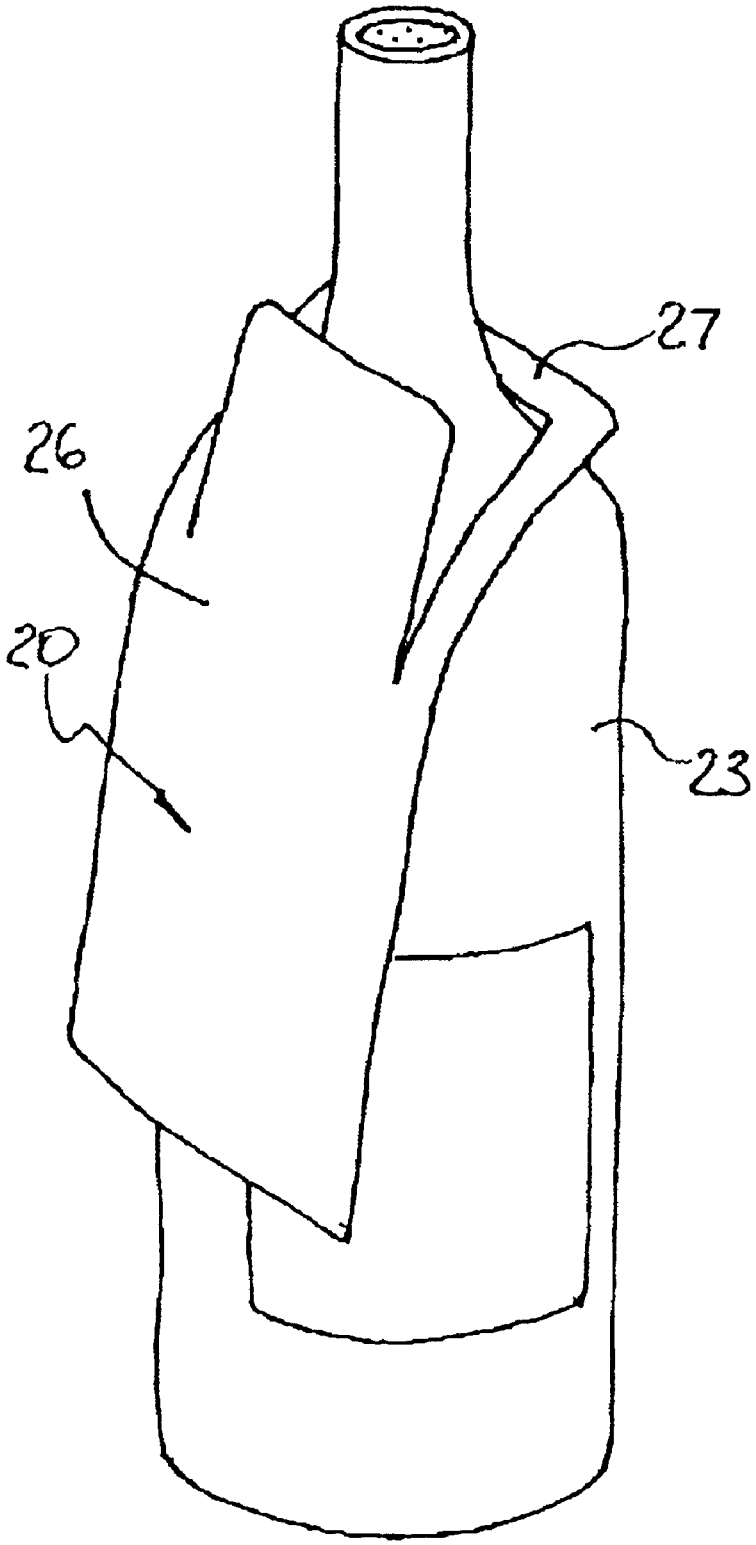
FIG. 1 is a pictorial view of a bottle, to which a greetings device that incorporates the invention has been attached.

In use of the device of the invention, a person wishing to give a bottle as a gift places the greetings-device over the neck of the bottle. As shown in FIG. 1, a greetings-device 20 has a been slipped over a wine-bottle 23.

Figure 2:
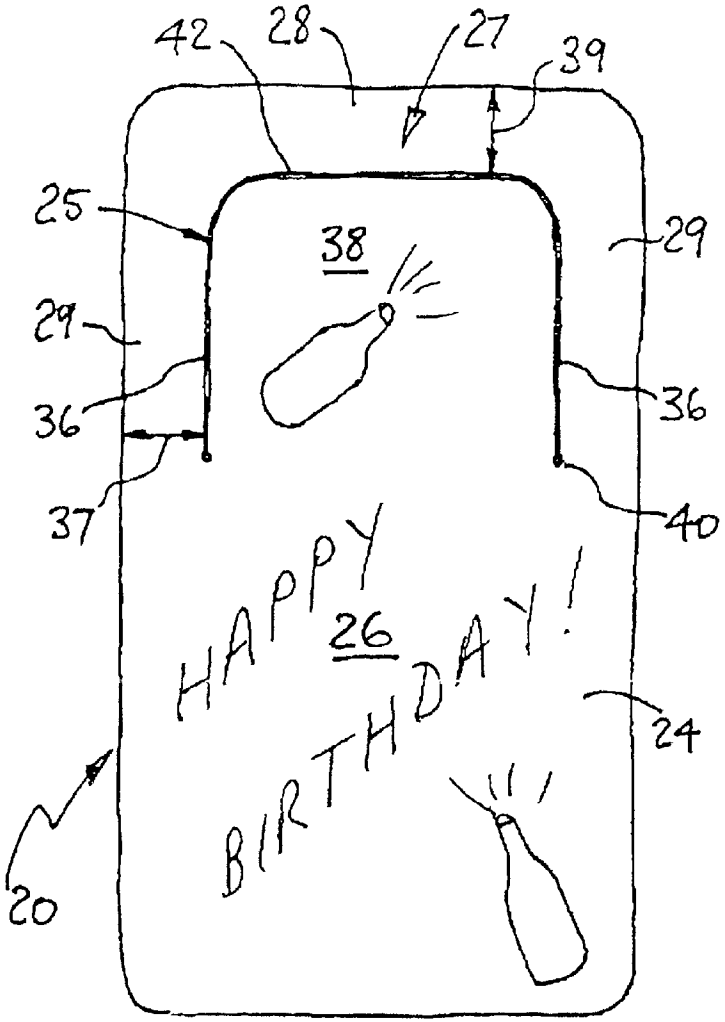
FIG. 2 is a plan view of the device of FIG. 1, in a flattened, as-manufactured, form.

The device 20 comprises a shaped sheet 24 of thin card, thick paper, or the like. The sheet 24 is provided with a cut slit 25. As shown in FIG. 2, the slit 25 is so shaped and arranged as to divide the sheet 24 into a message-carrying area 26, and a fixing-loop area 27. The slit 25 is disposed near the top of the sheet 24, and is of an inverted-U-shape, whereby the loop 27 has a horizontal cross-bar 28 and left and right vertical arms 29. The slit 25 is simply a cut: no material need be removed.

With the slit 25 shaped and positioned as shown, the message area 26 occupies most of the sheet 24, and is a comparatively plain and open expanse of the sheet. The greetings message can be pre-printed on the message area 26, and it can be arranged that the gift-giver writes a personal message on the message area. It can be arranged, alternatively, or in addition, that a pocket is provided in the message area 26, for receiving a small gift-tag, or the like.

Figure 4:
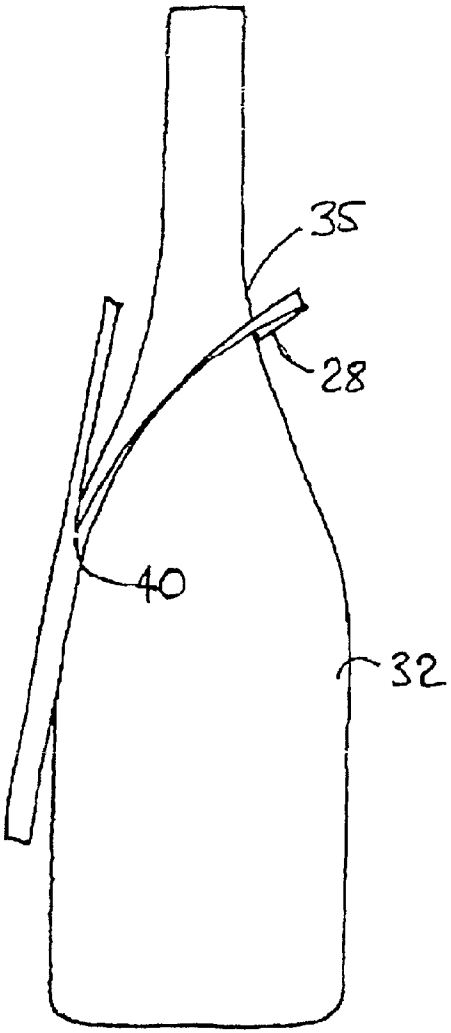
FIG. 4 shows the device of FIG. 1 attached to yet another kind of bottle.
Figure 3:
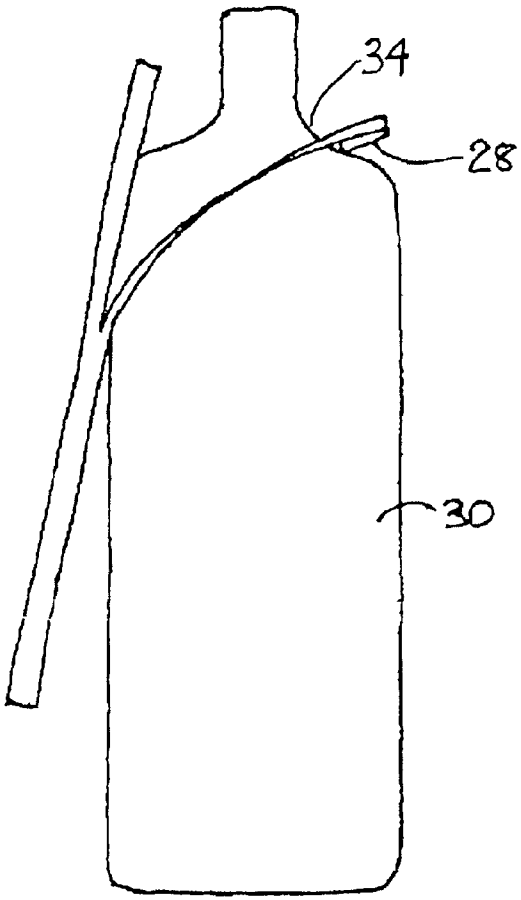
FIG. 3 shows the device of FIG. 1 attached to another kind of bottle.

FIGS. 3 and 4 represent the extremes of shape likely to be encountered between different bottles 30,32. As can be seen, the device 20 comes to rest, in both shapes of bottle, in more or less the same configuration, at least as far as presentation of the greetings message is concerned, (The loop area 27 of the device, however, as can be seen, comes to rest in quite different configurations, depending on whether the bottle has a marked shoulder area 34, or a long slender neck 35.)

In both extremes (i.e FIG. 3 and FIG. 4), the message area 26 is very well presented, being angled slightly upwards. If the device were to just hang down, i.e more vertically, the message would be not so prominently presented. If the device were to stick out further, i.e more horizontally, it would be vulnerable to damage. As can be seen, the device settles to the position in which it is angled slightly upwards, which is the manner of presentation that best combines prominent presentation with a reasonable lack of vulnerability to being damaged. The device also settles to a position in which it is secure, and cannot fall off or become detached without deliberate action.

The bottle may even be wrapped, with the greetings-device still in place, without the device being vulnerable to being damaged.

The greetings-device 20 can be made in a number of different sizes. The size of the sheet can be tailored to the needs of the greetings message, rather than to the needs of the bottle. That is to say, the card can be large or small, depending on the message to be displayed; the card need not be made large/small to suit large/small bottles, or large/small necks of bottles. Preferably, the device can be made in a range of three sizes: large, 8×5¼; medium, 7×4¼; small, 5½×4 inches overall.

The slit 25 must be sized and arranged to suit its function of creating a loop that fits over the neck of a bottle. Equally, the slit 25 should be tailored somewhat to the size of the sheet. To suit the bottle, the distance apart of the legs 36 of the slit should preferably be in the region of 3", with a minimum of about 2½ inches.

As to the length of the legs 36 of the slit, the preferred range is from about 1¾ to about 3 inches, The width and length dimensions of the slit, as explained below, are interdependent to some extent, in that the length of the slit preferably should not be greater than the width.

It is an aim of the invention that, when the bottle is resting on a table, the bottom of the greetings-device does not reach the table. The intention is that the greetings-device hangs from the bottle, i.e its weight is supported wholly by the bottle, and the device should be short enough for this to be the case. Of course, if the device were placed over a very small bottle, it would rest on the table; however, the device is intended for use mainly with wine bottles of the size that are traditionally given as gifts, and these bottles have a height of around eleven or twelve inches. It is recognised that the height of the greetings-device should be no more than about eight inches, as measured from the point 57 on the underside of the cross-bar to the lowermost point of the device.

The marginal-width 37 of the arms 29 of the loop created by the slit should preferably be such that the portion 38 of the message area 26 that lies between the legs 36 of the slit should be about ⅔ the overall width of the card. The marginal-width 39 of the cross-bar 28 of the loop 27 should be about the same, or a little wider.

The point 40 where the slit 25 ends is vulnerable to tearing. As can be seen from the drawings, the material of the sheet slopes away from the area of the end 40 of the slit, gently, and without causing a crease. There is little tendency for the material to fold or crumple at this critical point, The device is thus held securely in position, for good presentation of its message, and yet the device is simply a single sheet of paper or card, With a slit, to which nothing need be attached.

In a card that was 7×4¼ overall (which is a normal greetings-card size), the slit was inverted-U-shaped, the legs 36 of the slit being vertical, and 2¾ inches apart The marginal widths 37, 39 were everywhere about ¾" wide. The bottom-most extremities 40 of the legs of the slit were 2¾ inches down from the topmost point of the cross-bar 42 of the slit.

The use of the slit may be contrasted with providing the device with a simple hole, to accommodate the neck of the bottle. With a simple hole, the device could not be expected to fit such a wide variety of bottle and neck sizes. But with the slit, the loop comes to rest against the shoulder of the bottle, whether the neck is short and stubby or long and slender, and the message area is presented always in the same way, irrespective of the shape of the bottle. If the device had a simple hole, the same would not be true. With a hole, the angle at which the device came to rest might vary from nearly horizontal to nearly vertical; with the slit, the angle is much more consistent.

Another benefit the U-shaped slit has over a simple hole is that, with the slit, the device looks as if it is intended to be applied to a bottle, and has not been added on as an afterthought. With the slit, the message section of the card lies roughly vertical, and has the air of being applied to, or around, the bottle, which is almost as geared to the parameters of the bottle as is a stuck-on label. Of course, the device is clearly distinguishable from a stuck-on label; it is clear that the device, despite its appearance of being integrated with the bottle, is a specially-applied, personalised, greeting, unlike a factory-applied label.

The use of the slit with the cross-bar and two legs may be contrasted with a slit that was just a horizontal cut, for example, with no vertical legs. In that case, the strain placed on the ends of the slit would be much greater, and the tendency for the slit to become extended into a tear would be much greater. As mentioned, the vertical legs protect the vulnerable ends of the slit, by ensuring that the material of the sheet slopes gently and smoothly away from the ends of the slit.

It may be noted that the attachment loop 27 is not fragile. It is attached to the main body of the sheet by what is quite a wide area, at 37. The configuration of the slit allows the loop to perform its function while bending only in the plane of the paper, i.e there is little tendency for the ends of the slit to be pulled apart.

This is not to say that the sheet is indestructible, but rather that the sheet, even with its slit, can take its place with other greetings devices, as to the manner in which greetings cards are traditionally handled.

The loop 27 is very flexible in the mode in which the sheet undergoes curvature, and can adopt whatever curvature is necessary to accommodate itself to the shape of the bottle, as shown in FIGS. 3 and 4.

Figure 5:
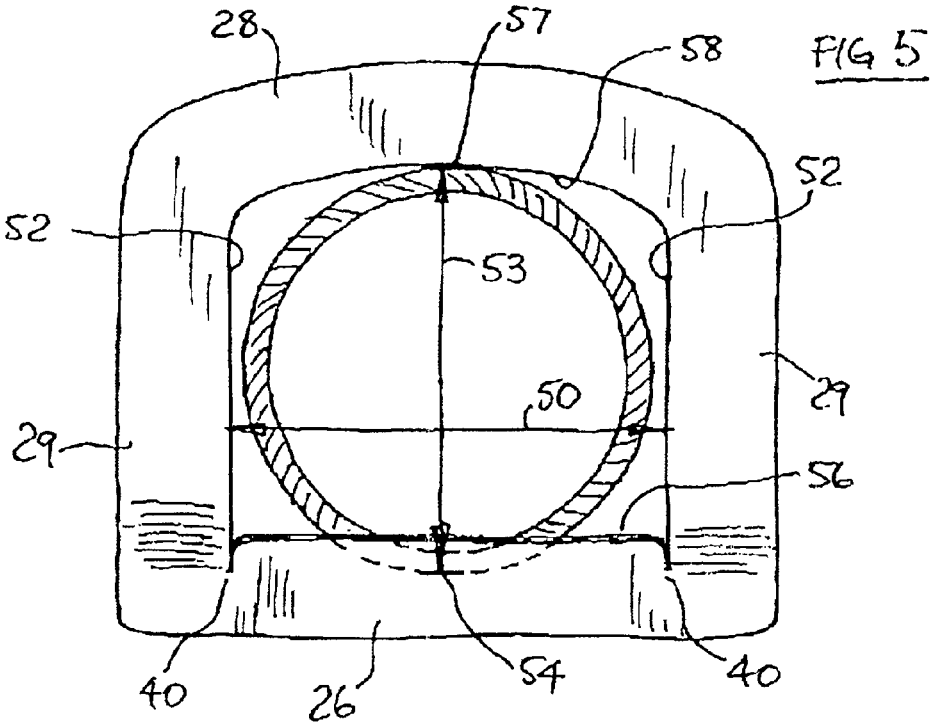
FIG. 5 is a plan view from above, of the device on a bottle.

FIG. 5 is a view of a greetings-device, in position on a bottle, looking down from above the bottle. This illustrates an important feature of the invention. Preferably, in the invention, the slit should be so shaped that the device touches (the neck of the bottle in the front/back sense, but not in the left/right sense. This will now be explained.

The left/right width 50 apart of the inside-edges 52 of the side-arms 29 is smaller than the front/back distance 53 between a point 54 on the inside-surface 56 of the front panel 26 of the device (being the point where the inside-surface 56 touches the bottle), and a point 57 on the inside-edge 58 of the cross-bar 28 (being the point where the inside-edge of the cross-bar touches the bottle).

Figure 6:
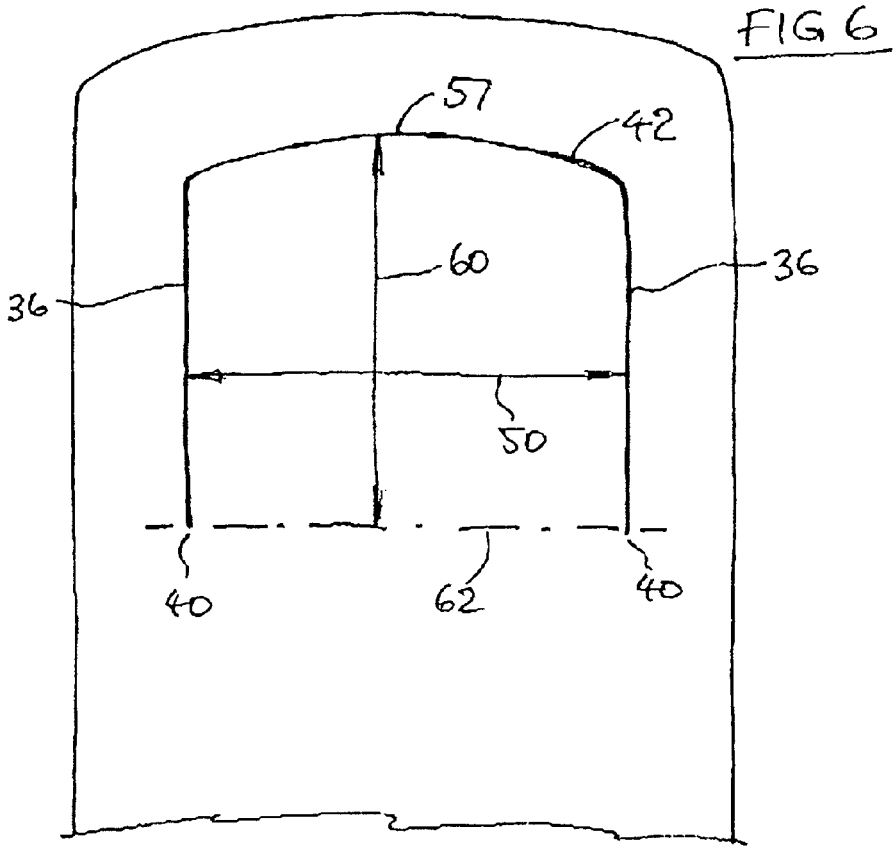
FIG. 6 is a view like that of FIG. 2 complementary to FIG. 5.

It should be noted that the front/back distance 53 varies, depending on the particular bottle, and on how much the fixing-loop of the device is bent over at the point where the device comes to rest on the bottle. However, no matter how bent over the fixing-loop might be, the dimension of the front/back width 53 cannot be less than the dimension 60. Dimension 60 is the distance measured from a line 62, which joins the bottom ends 40 of the slits, to the point 57 on the inside edge of the cross-bar, being the point thereon that rests in touching contact with the bottle. Thus, the dimension 53 is measured when the device is in place on the bottle, and may be termed the on-the-bottlen front/back width 53 of the panel 26, whereas the dimension 60 is measured when the device is laid out flat, as in FIG. 6, and thus may be termed the laid-out-flat front/back width 60.

In use, the device is lowered down onto the tapering neck of the bottle until it aches a position in which a point 54 on the inside-surface of the front panel 26 of the device touches the bottle, and the mid-point 57 of the inside-edge of the cross-bar touches the bottle. Because bottles are different, the position on the bottle at which this happens will vary, from bottle to bottle. However, whatever the position on the bottle in which the device comes to rest in all cases (provided the bottle is of circular cross-section) the left/right width 50 apart of he inside-edges 52 of the arms 29 is greater than the front/back width 53, whatever the front/back width 53 might be in a particular case. Again, the particular device, with its particular, as-manufactured, laid-out-flat front/back width 60, may vary as to its on-the-bottle front/back width 53, depending on the shape of the neck of the bottle.

In other words, the inside-edges 52 of the side-arms of the device never both touch the bottle. The device will always come to rest with the points 54 and 57 touching the bottle, and the inside-edges 52 of the arms 29 not touching the bottle.

In another particular example of the greetings-device, the inside-edges 52 of the side-arms 29 lie 2⅞ inches apart; i.e the left/right gap or width 50 is 2⅞ inches. The laid-out-flat front/back width 60 (measured while the device is flat) is 2¾ inches. On a bottle like that shown in FIG. 4, this device came to rest with the the points 54 and 57 touching the bottle, and the front/back width 53 (as measured in the plan view of FIG. 5) between the points 54 and 57 was about 2 inches; on a bottle like that shown in FIG. 3, the same device came to rest with a distance 53 of 2¼ inches, i.e the fixing-loop of the device was bent back a little more.

In the invention, the preference is that the front/back distance 60 (measured with the device flat, as in FIG. 6) be less than the left/right width 50. However, since the on-the-bottle front/back width 53 that is actually present when the device is resting on the bottle is less than the laid-out-flat width 60 measured when the device is flat, the condition that the device should come to rest with the inside-edges 52 not touching the bottle can be met even in cases where the laid-out-flat front/back width 60 is larger than the width 50.

However, the measured-flat front/back width 60 can only be allowed to be slightly larger than the width 50; if the laid-out-flat frontback width 60 were too much larger than the on-the-bottle left/right width 50, the on-the-bottle front-back width 53 might turn out to be larger than the left/right width 50: and if that happened, the inside-edges 52 of the side-arms 29 would touch the bottle first, which is the condition to be avoided because it would cause stress at the highly-vulnerable points 40. It is recognised, in the invention, that the width of the gap 50 might be up to ½-inch smaller than the measured-flat front/back distance 60, and still the likelihood would be that the on-the-bottle front/back distance 53 would be smaller than the width 50.

Thus, it is essential, in the invention, that the left/right width 50, being the gap between the side-arms 29 of the device, be no more than about ½-inch greater than the front/back width 60, being the distance from the line 62 joining the bottom ends of the U-shaped slit to the inside-edge of the cross-bar, as measured with the device flat. But preferably, the laid-out-flat front/back width 60 should be smaller than the left/right width 50; then, there can be no danger whatever, on any bottle, of the device coming to rest on the bottle with the device resting on the inside-edges of the side-arms.

It might not matter if the inside-edges 52 of the side-arms did both just touch the bottle, so long as the main weight of the device was resting on the points 54 and 57. What would matter is the device coming to rest on the bottle, with its weight applied to the side-arms, and the points 54 and 57 not touching. This would make the side-arms twist and bend, and put extra stresses and strains into the material. The vulnerable material at the bottom ends 40 of the slit, especially, would be subject to extra stresses, tending to force the slit apart, and thereby increasing the risk of tearing. It is recognised, in the invention, that the arms of the device should not be forced apart by the bottle, and that this condition can be ensured by making the front/back gap smaller than the left/right gap. With the device as depicted herein, the device always settles to a position on the bottle, whatever the shape and size of the bottle, in which the arms do not touch the bottle.

In another version of the greetings-device, the inside-edges produced by the slit might not be straight. In that case, the important dimensions would be the dimensions between the points on the inside-edges that touch, or most closely approach, the sides of the bottle. The width between the legs of slit should be measured as a minimum width, and should be measured below about 1 inch down from the point 57, since if there were to be a large radius in the corner between the side-arm 29 and the cross-bar 28 of the fixing-loop, that would be of no consequence.

It might be considered that the vulnerable areas at the bottom-ends of the slit might be better protected from tearing by making the leg portions 36 of the slit as long as possible. However, as explained, the key to protecting the bottom-ends 40 is to make sure that the device comes to rest on the bottle with the inside-edges of the side-arms not touching the bottle. As may be understood from FIG. 1 and FIG. 5, the side-arms just curve gently away from the bottom-ends of the slit; there is very little tendency for the bottom-ends to be subjected to pulling-apart forces. On the other hand, it will be understood that if the device were resting on the inside-edges of the left and right side-arms, there would be inescapable pulling-apart forces applied to the bottom-ends of the slit.

FIG. 7 shows an envelope, which may be used for enclosing the greetings device while the device is on the bottle, in case the gift-giver prefers to keep the greetings message private. The envelope 70 is made from a single sheet of paper, which is cut and glued to the configuration shown. The bottom portion of the greetings device 20 fits into a lower pocket 72, and the upper portion 38 of the display panel fits into an upper pocket 73. The envelope permits the side-arms and cross-bar of the fixing-loop to remain free, whereby tie device can still be slipped over a bottle, inside the envelope.

The envelope 70 may, if desired, be pre-made; that is to say, the two pockets may be formed (i.e glued in place) prior to insertion of the greetings device, However, the risk of damage to the device, from bending the device to insert it into the pockets, is rather high. Alternatively, the envelope may be arranged to be assembled by the gift-giver. In this case, the upper pocket is left unglued, but is provided with margins of lick-to-stick glue; the gift-giver writes the message while the greetings device is laid flat, and then slips the device into the pre-made lower pocket, and then, having licked the glue, makes the upper pocket by folding the paper of the envelope over the device.

FIG. 8 shows another version of the greetings device, in which the device comprises two thicknesses of paper or card. The two thickness are formed from a single sheet 80, which is crease-folded at 82. The U-shaped slits 83 match and overlie each other. The gift-giver may write the greeting on what will be an inside face of the folded-over device, which again enables the message to remain at least partially concealed.

The device as described is inexpensive, and is simple to manufacture, being simply a stamped-out shape like any other greetings card. During manufacture, the device is flat, and can be printed, embossed, etc, as desired, just like any greetings card. Stocks of the device are easy to transport and store, stacked in boxes. Equally, the device is flat, just prior to its being applied to the bottle, so that it is a simple matter for the gift-giver to hand-write a personal message onto the device. With the device as depicted, there are no other components that need to be separately coordinated and assembled to the card, in order for the device to be properly mounted on the bottle.

What is claimed is:

1. Greetings device, comprising a sheet of thick paper or card material, wherein:

the sheet has a top edge, a bottom edge, and left and right side-edges;

the sheet includes a slit, which extends right through the material of the sheet;

the slit is of an inverted U-shape, having a cross-portion of the silt that lies adjacent to and alongside the top edge of the sheet, and having left and right leg-portions of the slit, which lie adjacent to and alongside the left and right side edges of the sheet, and which extend down to respective left and right bottom ends of the leg-portions;

the configuration of the slit is such as to create a front-panel portion of the sheet and a fixing-loop portion of the sheet;

the fixing-loop portion of the sheet, thus configured, comprises a cross-bar portion, which is marginal with respect to the top-edge of the sheet, and left and right side-arms, which are marginal with respect to the left an right side-edges of the sheet;

the configuration of the sheet with the slit therein is such: that the device is suitable for fitment over the neck of a bottle, the front-panel portion in front of the bottle, and the fixing-loop portion around and behind the neck of the bottle;

as to create a gap between the side-arms, into which, when the device fitted over the bottle, the neck of the bottle is received;

that the gap, as a whole, is so wide that the device cannot come to rest on the bottle with both side-arms touching the neck of the bottle;

that the device comes to rest on the neck of the bottle in such manner that the side-arms curve gently back from the front-panel portion, without imparting a strain at the bottom ends of the slit tending to tear the side-arms away from the front-panel portion;

a front/back width of the device is defined as the distance from a line joining the left and right bottom-ends of the silt to the furthest point on the cross-portion of the slit, the front/back width being measured with the device laid out flat;

a left/right width is defined as the width between the left and right leg-portions of the slit;

the left/right width, plus ½-inch, is greater than the front/back width; and the front/back width is smaller than 3 inches.

2. Device of claim 1, wherein the front/back width is smaller than 2½ inches.

3. Device of claim 1, wherein the front/back width is greater than 2½ inches.

4. Greetings device, comprising a sheet of thick paper or card material, wherein:

the sheet has a top edge, a bottom edge, end left and right side-edges;

the sheet includes a silt, which extends right through the material of the sheet;

the slit is of an inverted U-shape, having a cross-portion of the slit that lies adjacent to and alongside the top edge of the sheet, and having left and right leg-portions of the slit, which lie adjacent to and alongside the left and right side edges of the sheet, and which extend down to respective left and right bottom ends of the leg-portions;

the configuration of the slit is such as to create a front-panel portion of the sheet and a fixing-loop portion of the sheet;

the fixing-loop portion of the sheet, thus configured, comprises a cross-bar portion, which is marginal with respect to the top-edge of the sheet, and left and right side-arms, which are marginal with respect to the left an right side-edges of the sheet;

the configuration of the sheet with the slit therein is such:- that the device is suitable for fitment over the neck of a bottle, the front-panel portion in front of the bottle, and the fixing-loop portion around and behind the neck of the bottle;

as to create a gap between the side-arms, into which, when the device is fitted over the bottle, the neck of the bottle is received;

that the gap, as a whole, is so wide that the device cannot come to rest on the bottle with both side-arms touching the neck of the bottle;

that the device comes to rest on the neck of the bottle in such manner that the side-arms curve gently back from the front-panel portion, without imparting a strain at the bottom ends of the slit tending to tear the side-arms away from the front-panel portion;

a front/back width of the device is defined as the distance from a line joining the left and right bottom-ends of the slit to the furthest point on the cross-portion of the slit, the front/back width being measured with the device laid out flat;

a left/right width is defined as the width between the left and right leg-portions of the slit;

the left/right width, plus ½-inch, is greater than the front/back width; and the left and sight side-arm portions of the fixing-loop portion of the sheet have a width each of at least ½ inch, measured at any point of the fixing-loop portion.

5. Device of claim 4, wherein the left/right width is greater than the front/back width.

6. Device of claim 4, wherein the let/right width is greater than 2½ inches.

7. Device of claim 6, wherein the left/right width is greater than 3 inches.

8. Device of claim 4, wherein:

left and right halves of the device are symmetrical;

the distance from the left bottom-end of the slit to the nearest point on the left side-edge of the sheet is at least ½ inch.

9. Device of claim 8, wherein:

the left/right width is greater than the front/back width;

the left/right width is greater than 2½ inches;

the front/back width is smaller than 3 inches;

the front panel comprises an upper portion and a lower portion;

the upper portion has a width as defined by the distance between the leg-portions of the silt;

the lower portion is wider than the upper portion;

and the left and right leg-portions of the slit are straight and parallel.

10. Device of claim 4, wherein a greetings message is printed on the front panel of the sheet.

11. Device of claim 4, wherein the sheet of material is attached to and folded over, a second sheet of material, and the second sheet of material includes a second inverted U-shaped slit, corresponding to the said U-shaped slit.

12. Device of claim 4, in further combination with the bottle.

13. Device of claim 12, wherein the dimensions and configuration of the device are such that, when the bottle is resting on a surface, and the device has been fitted over the neck of the bottle, that the device rests on the neck of the bottle with the bottom edge clear of the surface.

14. Greetings device, comprising a sheet of thick paper or card material, wherein:

the sheet has a top edge, a bottom edge, and left and right side-edges;

the sheet includes a slit, which extends right through the material of the sheet;

the slit is of an inverted U-shape, having a cross-portion of the slit that lies adjacent to and alongside the top edge of the sheet, and having left and right leg-portions of the slit, which lie adjacent to and alongside the left and right side edges of the sheet, and which extend down to respective left and right bottom ends of the leg-portions;

the configuration of the silt is such as to create a front-panel portion of the sheet and a fixing-loop portion of the sheet;

the fixing-loop portion of the sheet, thus configured, comprises a cross-bar portion, which is marginal with respect to the top-edge of the sheet, and left and right side-arms, which are marginal with respect to the left and right side-edges of the sheet;

the configuration of the sheet with the slit therein is such;

that the device is suitable for fitment over the neck of a bottle, the front-panel portion in front of the bottle, and the fixing-loop portion around and behind the neck of the bottle;

as to create a gap between the side-arms, into which, when the device is fitted over the bottle, the neck of the bottle is received;

that the gap, as a whole, is so wide that the device cannot come to rest on the bottle with both side-arms touching the neck of the bottle;

that the device comes the rest on the neck of the bottle in such manner that the side-arms curve gently back from the front-panel portion, without imparting a strain at the bottom ends of the slit tending to tear the side-arms away from the front-panel portion;

a front/back width of the device is defined as the distance from a line joining the left and right bottom-ends of the slit to the furthest point on the cross-point of the slit, the front/back width being measured with the device laid out flat;

a left/right width is defined as the width between the left and right leg-portion of the slit;

the left/right width, plus ½-inch, is greater than the front/back width;

in further combination with an envelope, wherein:

the envelope is formed with a lower pocket, which is dimensioned to fit a lower portion of the front panel, being that portion of the front panel that lies below the line joining the left and right bottom ends of the slit;

the envelope is formed with an upper pocket, which is dimensioned to fit an upper portion of the front panel, being that portion of the front panel that lies above the line joining the left and right bottom ends of the slit, and between the leg-portions of the slit;

and the envelope is so dimensioned that, with the pockets in place on the portion of the front panel, the fixing-loop portion of the sheet is unencumbered by the envelope, and remains suitable for fitment around the bottle.

* * * * *